United States Patent [19]

Deese

[11] 4,043,477

[45] Aug. 23, 1977

[54] COIN DISPLAY

[76] Inventor: Raymond E. Deese, P.O. Box 1120, Placentia, Calif. 92670

[21] Appl. No.: 658,776

[22] Filed: Feb. 17, 1976

[51] Int. Cl.[2] ..... B65D 21/02

[52] U.S. Cl. ..... 220/23.4; 53/37; 206/.83; 206/45.11; 206/445; 206/504; 312/111

[58] Field of Search ..... 312/107, 111; 220/23.4, 220/23.6; 206/.8, .81, .82, .83, .84, 486, 504, 511, 45.11, 45.31, 445, 472, 303, 820; 53/26, 37

[56] References Cited

U.S. PATENT DOCUMENTS

| | | | |
|---|---|---|---|
| 2,341,635 | 2/1944 | Loesch | 211/59 |
| 2,844,248 | 7/1958 | Tiberio | 206/.83 |
| 2,998,126 | 8/1961 | Jenkins | 206/.83 |
| 3,057,459 | 10/1952 | Burdick | 206/.83 |
| 3,139,977 | 7/1964 | Burdick | 206/.81 |
| 3,425,586 | 2/1969 | Petters et al. | 220/23.4 |
| 3,438,534 | 4/1969 | Zerwes | 220/266 |
| 3,489,314 | 1/1970 | Slapnik | 220/23.6 |
| 3,539,071 | 11/1970 | Ludder | 220/23.6 |
| 3,744,867 | 7/1973 | Shaw | 116/121 |
| 3,788,464 | 1/1974 | Skinner | 206/.82 |

FOREIGN PATENT DOCUMENTS

| | | | |
|---|---|---|---|
| 436,554 | 3/1912 | France | 206/.81 |
| 2,336,934 | 2/1975 | Germany | 220/23.4 |
| 1,611,027 | 9/1970 | Germany | 206/.84 |
| 1,106,395 | 3/1968 | United Kingdom | 206/.82 |

*Primary Examiner*—William Price
*Assistant Examiner*—Bruce H. Bernstein
*Attorney, Agent, or Firm*—Knobbe, Martens, Olson, Hubbard & Bear

[57] ABSTRACT

A square, flat display device is formed with recesses on its edge for receiving interlock elements having portions which are captured by adjacent devices. Thus, a group of display devices may be connected to form a sheet of devices. Mounting members are similarly attached to the devices so that a sheet of devices may be mounted in a ring binder.

13 Claims, 7 Drawing Figures

COIN DISPLAY

This invention relates to an improved system for mounting or displaying coins or similar items and, more particularly, to an improved, reusable display device.

Coin collectors frequently like to mount or display their more valuable coins in containers or display devices to highlight the appearance of the coin. The display device also protects the coin from wear and deterioration caused by handling and by the atmosphere. Often it is desirable to mount a single coin in a holder but, in other instances, it is highly desirable to mount a plurality of coins in an album for convenience of viewing. Such an arrangement is particularly handy for coin dealers.

While there are a variety of coin-mounting arrangements on the market, they all have various shortcomings. One of the more widely used arrangements is simply a container made of two sheets of plastic or cellophane mounted in a cardboard frame by staples. The container is partially closed when the coin is inserted and then the fourth side of the holder may be stapled closed so as to confine the coin. While such an arrangement is relatively inexpensive, at least intially, it may not be in the longer term in that the device is usually mutilated if a coin is to be removed and, therefore, is often discarded. Also the arrangement is not very impressive in appearance and the container is not sealed to any significant degree. Another shortcoming is that it is not convenient for mounting a group of coins in sheet form. Accordingly, a need exists for an approved display system.

In accordance with the present invention, the coins or other articles are mounted in individual holders that are very useful and practical for displaying a single article, but the holders can also be easily connected to and disconnected from similar holders so that a group of articles can be mounted as a separate page or sheet. If an article is to be removed, any of the individual display devices can be opened for that purpose and reclosed after the article is returned to the display device.

In a preferred form of the invention, the display device comprises a base and a cover which cooperate together to form an inner chamber in which the coin or other article to be displayed is positioned. On at least one edge of the display device, a recess is formed which is shaped to receive and capture a portion of an interlocking element which is attached to an adjacent, similar display device.

In one form the recess for receiving the element is formed by both the cover and the base with the result that the element is first positioned in the base and then captured when the cover is installed.

While the interlocking elements could be mounted or formed integral with an individual display device and then other devices formed with the mating recess for the interlocking element, it is preferable that the interlocking element be a separate piece so that each display device can be identical with the desired recess. This has manufacturing advantages. Thus, a recess is formed on each edge of the display device so that additional displays can be added to any size. If it is desired that no display be added on a particular side, there is no need to use an interlock element on that side. Consequently, that side is left with a fairly finished appearance.

In some instances, it is desirable to mount a group of interconnected display devices in an album such as a binder having rings of the familiar looseleaf notebook type. For this purpose, special mounting elements are provided, each having a hole for receiving the binder and each having a projecting portion which is similar to one-half of an interlocking element so that such portion may be captured within the edge recess of one of the display devices. A sheet of display devices may be provided with any desired number of mounting members.

The chamber for receiving the coin or other article is defined by a frame of short, upstanding walls integral with the base. Additional wall portions surrounding the inner wall cooperate with the inner wall to define a groove which is intended to receive a depending rib formed on the lid. Also, the outer wall portions and the rib on the cover partially define the recesses for receiving the interlocking elements.

As another feature of the invention, there is provided a special insert which fits within the chamber in the display device to form a frame or border for the article being displayed. Such border enhances the appearance of the article and also enables the display device to be made in a standard size in that the insert may be formed to accommodate the particular size article to be displayed. In accordance with the invention, the insert is formed with a plurality of concentric circles defining sections that can easily be punched out to obtain the desired insert size. For example, the inner circle may have a diameter equal to the diameter of a dime and a surrounding circle equal to the diameter of a quarter. Thus, if a dime is to be mounted in the display device, it is only necessary to punch out the inner circular section. If the quarter is to be mounted in the display device, the inner circular section is punched out along the surrounding ring-shaped section. By making the insert of a soft, resilient plastic, additional protection is provided for the coin.

For a more thorough understanding of the invention refer now to the following detailed description and drawings in which.

Figure 1:
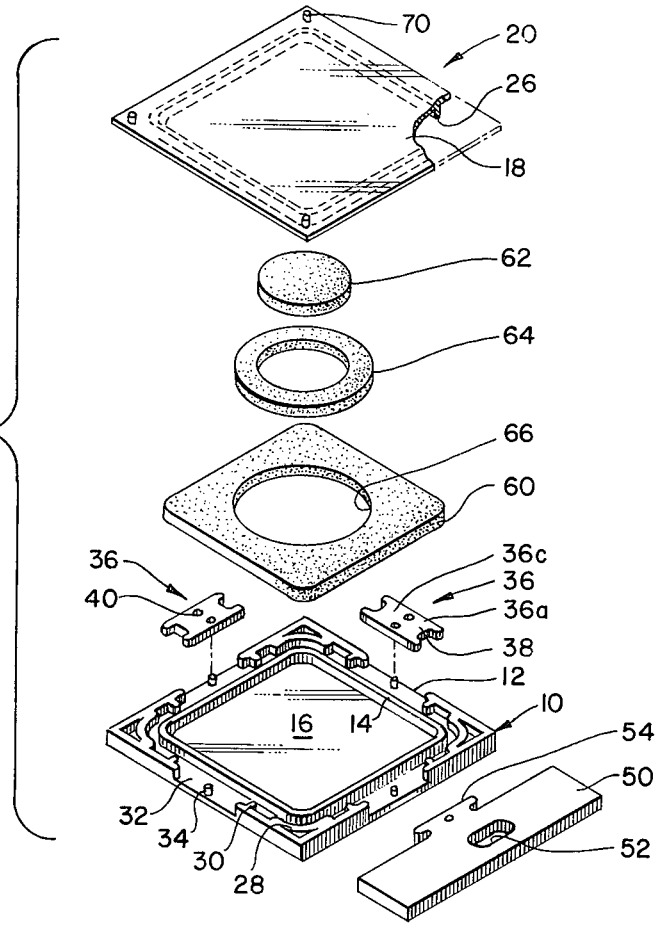
FIG. 1 is an exploded perspective view of a single display device with a pair of interlocking elements and a sheet-mounting member, together with one of the inserts of the invention.
Figure 2:
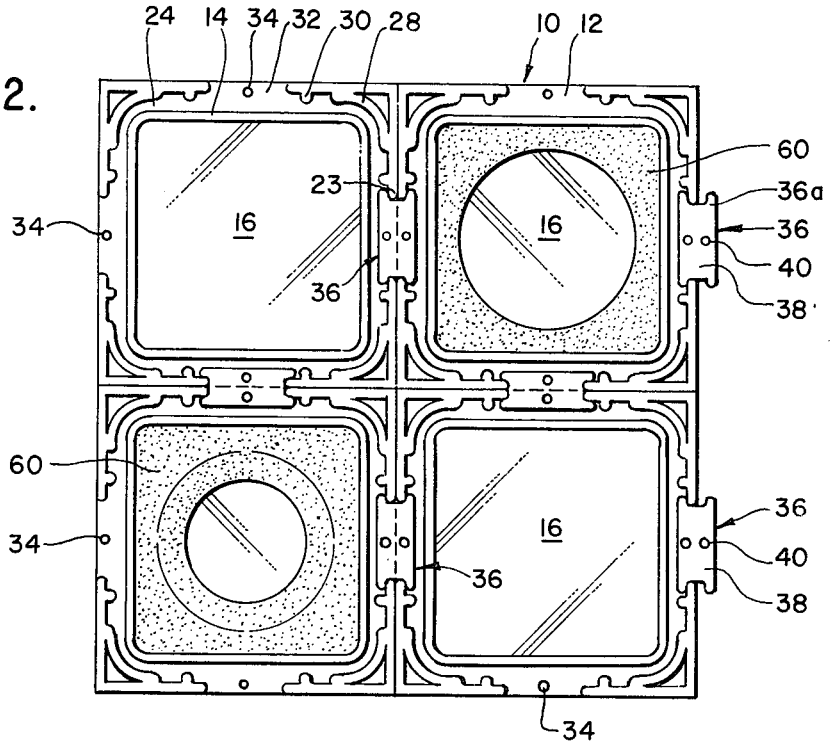
FIG. 2 illustrates four of the display devices interconnected with two of the devices having inserts of different sizes.
Figure 3:
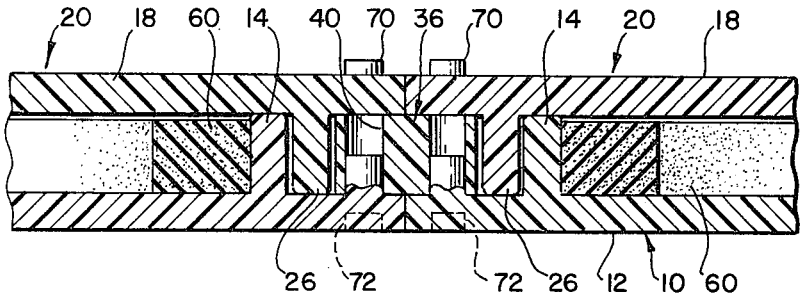
FIG. 3 is a cross-sectional view taken on line 3—3 of FIG. 4 illustrating the connection between the cover and the base and the cooperation between the interlock elements and the base and the cover.

Referring now to FIGS. 1, 2 and 3, it may be seem that the display device includes a base 10 having a generally flat, square configuration. The base 10 has a bottom wall 12 with an inner short upstanding wall 14 which forms the outer edge for an inner square chamber 16 which is further defined by the bottom wall 12 and by the central portion 18 of a cover 20.

The base 10 is further provided with upstanding wall portions 22, the inner surfaces of which are spaced from the wall 14 to define a continuous groove 24 adapted to frictionally receive a rib 26 depending from the cover 20.

As can be seen from FIGS. 1 and 2, the wall portions 22 are situated at each corner of the base 10. While the wall portions 22 could be made solid, they have been formed with various voids to minimize the amount of material required and to minimize the weight of the base. Thus, each wall portion 22 is formed with a corner inner section 28 which forms the outer wall for receiving the corners of the rib 26 on the cover 20. The wall sections 22 further include ribs or stub walls 30 which extend inwardly from the outer edge of the base to further help in positioning the cover rib 26.

As can be seen, a recess 32 is formed in each edge of the base 12, such recess opening to the groove 24 and opening to the outer periphery of the base. The stub walls 30 form end boundaries of the recesses 32. A positioning detent or button 34 extends upwardly from the bottom wall 12 of the base 10 in each of the recesses 32, being located centrally in each recess close to the outer periphery of the base.

Each recess 32 is sized to receive an interlock elements 36, two of which are shown in FIG. 1. The interlock elements are symmetrical and have somewhat of a distorted H shape with one vertical half of the H-shaped element being adapted to fit within a recessed 32 of one display device and the other half of the interlock 36 being adapted to fit within recess 32 of an adjacent display device as best seen in FIG. 2.

As further description of the interlock element 36, it may be said that it has two elongated edge sections **36*a* which are opposite from each other and are joined by a central shorter section 36*b*. Two notches or spaces 38 are formed on the opposite ends of the interlock device defined by the ends of the elongated sections 36*a* and by the ends of the central section 36*b*. As seen from FIG. 2, the width of such notches or spaces 38 is equal to the thickness of two of the base wall sections 23 at the point where the recesses 32 open to the periphery of the base. Thus, two adjacent display devices are held close to each other so that they can be moved as a unit. The length of the elongated sections 36*b* on the interlock is greater than the length of the recess 34 at the point where it opens to the edge of the base 10. Consequently, when the interlock element 36 is positioned in the recesses as shown in FIG. 2, it is captured within the recess when the covers 20** are mounted on the bases.

Each interlocking element 36 is formed with a pair of small holes 40 which are positioned and sized to receive the buttons 34 extending upwardly from the bottom wall 12 of adjacent display devices, as best seen in FIG. 3. This arrangement is convenient for positioning the interlock elements 36 and the base 10 before the cover is placed on the base.

Also illustrated in FIG. 1 is a mounting member 50 which has a rectangular shape with a length about equal to that of the base 10. The mounting member has a hole 52 which is elongated in the direction of the longer dimension of the rectangular mounting member 50. Extending outwardly from the central portion of one edge of the mounting member 50 is a portion 54 which is equal to one-half of an interlock element 36. Consequently, the portion 54 is adapted to be received within a recess 34 of the base 10.

Further illustrated in FIG. 1 is an insert 60 having a generally square external configuration with rounded corners dimensioned to fit within the chamber 16 in the base 10. The insert includes an inner circular section 62 which is initially connected to a surrounding annular section 64 which, in turn, is initially connected to a surrounding circular edge 66 of the insert 60. Thus, the insert is initially formed as one piece with the section 62 and section 64 connected by weakened portions so that they can easily be punched out to provide the desired inner diameter for the insert.

Preferably, the insert 60 is made of a soft plastic which will not damage a coin. The material may be made in a variety of colors to enhance the mounting of the coin.

The display device itself is preferably formed of a rigid, transparent plastic which is easily molded, has sufficient strength, and will not damage the coin.

The display device can be made in whatever size desired, and can be used to display a variety of items. When it is to be used as a coin holder, the most useful arrangement would be to make the width of the chamber 16 approximately equal to the diameter of a silver dollar. In such case, no insert 60 is required. If a smaller coin is to be displayed, an insert is utilized and the section corresponding to the diameter of the coin is punched away from the remainder of the insert. The insert and the coin are then positioned in the chamber 16 of the base 10. If the coin is going to be separately displayed, it is only necessary to snap the cover onto the base in a position wherein the rib 26 is frictionally received within the groove 24 of the base.

If it is contemplated that the display device is to be attached to another display device, an interlock element 36 is positioned in a recess 34 along one edge of the display device before the cover is installed. Note that the hole 40 will fit over a button 34 to properly align the interlock element. If display devices are to be attached to all sides of the base, an interlock 36 may be positioned in the recess on each side. The cover 20 may then be positioned onto the base with its rib 26 extending into the groove 24, thus capturing any interlock elements 36, in the positions shown in FIG. 2 drawings. Any number of display devices may be connected in this manner. Note that at any time a cover can be removed so that a particular coin can be replaced. Or, if a particular display device should be removed from a group of devices, they can be easily disassembled to accomplish this. Thus, it can be seen that the devices are completely reusable.

Figure 4:
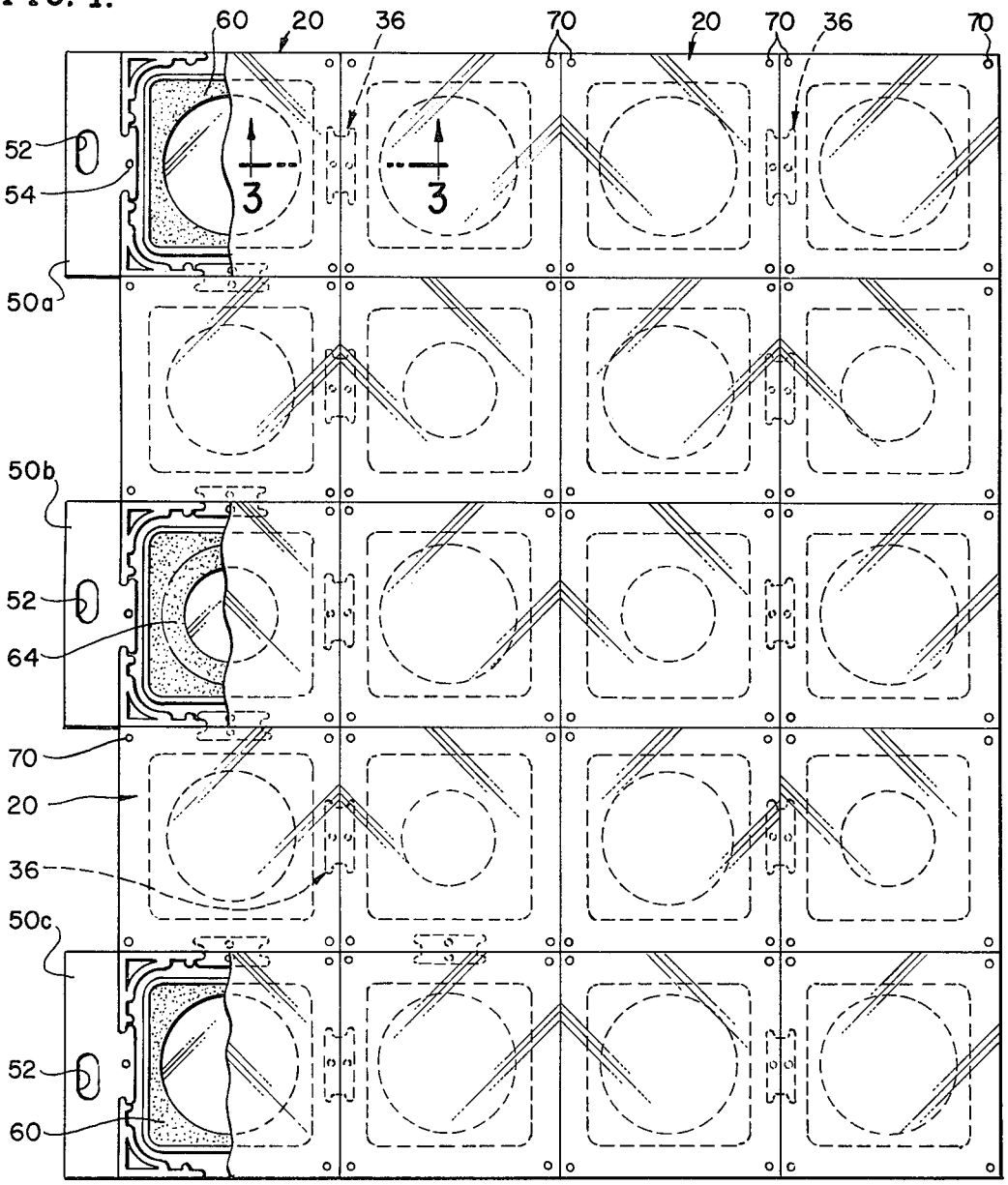
FIG. 4 shows twenty display devices interconnected to form a single sheet approximately eight by ten inches with three mounting members attached to three of the edge display devices for mounting the sheet in a three-ring binder.

If desired, an entire page or sheet of display devices may be assembled as shown in FIG. 4. Note that the configuration of the interlock 36 is such that the adjacent display devices are abutting at their edges. This enables the devices to support each other so that the entire sheet or page can be turned in a binder much like a heavy page of a photo album. In the arrangement shown, three mounting members 50 are locked onto three of the display devices for mounting the sheet in a binder. The dimensions of the display devices are such that the holes for the top or end members **50*a* and 50*b* could not simply be centrally positioned. Thus the hole is elongated and slightly off center. That is, it extends from the center towards one edge. For the central member 50*c* in FIG. 4, the ring of the binder would fit within the center of the member 50 which is the lower end as viewed in FIG. 4. The ring for the upper member 50*a* would extend through the upper end of the opening 52, and the ring for the lower member 50 would extend through the lower end of the opening 52. With this arrangement, any member 50 can be used for any position and the central member 50c can have either side facing up as viewed in FIG. 4. Any member 50 can also be used for the member 50a and 50b, as shown in FIG. 4 but the elongated slot must be properly oriented. The mounting members can be inverted end-for-end so that the hole 52 is properly positioned. This arrangement is utilized for a standard, three-ring binder; however, specially designed binders could be utilized so that the holes 52** in the mounting members would not have to be elongated. Similarly, the dimensions of the display devices can be varied, as desired, however, in a production version of the device, the dimensions worked out as described for the optimum configuration of the display device itself.

One other feature of the invention is that a projecting button or foot 70 is formed on the upper surface of each corner of the cover 20 as shown in FIGS. 1 and 3. Also, a shallow recess 72 is formed in the bottom surface of the bottom wall 12 of the base 10 at each corner of the base. The recesses 72 are sized to receive a foot 70 on the cover 20. These mating feet and recesses facilitate stacking of display devices if they are to be stored in this manner.

Figure 5:
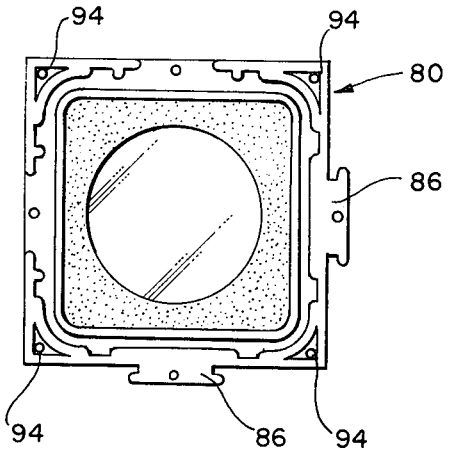
FIG. 5 is a plan view of a display device having integral interlocking elements.

It should be understood that the interlock elements can be formed integral with either the base or the cover of a particular display device along one or more edges, and such device could be connected to other display devices having recesses of the type illustrated. Such a system is shown in FIG. 5, wherein interlock elements 86 are shown formed integral with two sides of a base 80 which is similar to the base 10. A disadvantage of this system is that the display device having the integral interlock elements is not as desirable for individual mountings with the interlock elements projecting from the edges. Similarly, display devices having outwardly extending integral interlock elements are not suitable for edge devices if a sheet of devices were to be formed as illustrated in FIG. 4.

Figure 7:
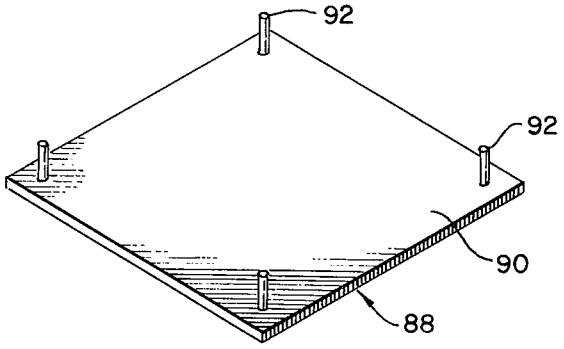
FIG. 7 is a perspective view of the tool used in FIG. 6.

It is desirable that the cover 20 fit snugly on the base 10 to prevent the components from inadvertently separating. This is particularly important when a sheet of display devices is being handled. A tight fit also helps seal the inner chamber from the environment. With a tight fitting lid, it is helpful to have a tool for separating a cover from the base. It is particularly difficult to remove a cover in the center of a sheet of display devices wherein the edges of the cover are not accessible for gripping. FIG. 7 illustrates a tool 88 for this purpose.

Figure 6:
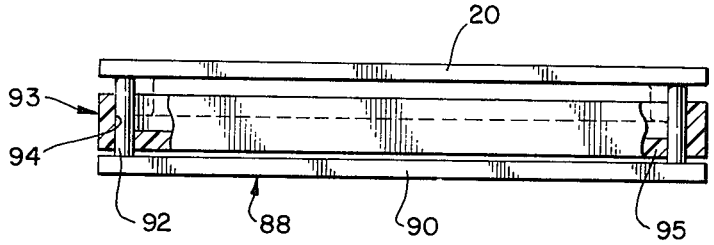
FIG. 6 is an elevational, partially sectionalized view of a display device lid being separated from its base by a special tool.

As can be seen, a flat plate 90 about the size of a display device cover 10 is provided with four pins 92, one on each corner, extending perpendicularly away from the plate 90. Referring to FIG. 6, the base 93 of a display device is formed with a hole 94 on each corner through its bottom wall 95. For purpose of illustration such holes 94 are also shown in the base 80 of FIG. 5. These holes are spaced and sized to receive the pins 92 of the tool 88. Thus, by inserting the pins into the holes 94 from the bottom side of the base, the ends of the pins will engage the lower surface of the cover 20[1]. In this way, the cover can be easily pushed away from the base to open the display device.

What is claimed is:

1. A display device comprising:

a base and cover which fit together to form a chamber for receiving the article to be displayed;

means on said base and cover formed on at least one edge of the device defining a recess;

interlocking means positioned in said recess for removably attaching the device to an adjacent, similar device so that a group of the devices may be readily joined to form a larger display assembly, said recess means being formed by both said base and said cover in a manner such that said interlocking means is initially positioned on said base in said recess and then captured in the recess when the cover is placed onto the base.

2. The device of claim 1 wherein said base has upstanding wall means forming a groove around the base, spaced slightly inwardly from the edge of the base, the inner portion of the wall means defining the outer edge or frame of said chamber, said cover having a depending rib adapted to frictionally fit within said groove, the walls forming the outer portion of said groove being interrupted at desired locations open to the edge of said base to form said recess with said cover for receiving the interlocking means.

3. The display device of claim 2 including detent means formed on said base for positioning said interlock so that the cover will fit on said base and not interfere with the interlock.

4. The display device of claim 1 wherein the upper surface of said cover and the lower surface of said base are formed with mating feet and recesses to facilitate stacking of a series of display devices.

5. The device of claim 1 wherein said interlocking means is symmetrical and has a pair of straight, elongated opposing edge portions joined by a shorter mid-section, each of said edge portions being adapted to fit within a recess of adjacent display devices while the mid-section extends through portions of the recesses opening to the edges of the adjacent display devices, and each of said edge portions being longer than the opening through the edge of the devices through which said mid-section extends.

6. The display device of claim 5 including a mounting member having a hole in it adapted to receive a binder ring, said mounting member having a portion shaped like one-half of an interlock element which will fit within a recess of a display device so that the device can be mounted removably in a binder.

7. The display device of claim 1 having a plurality of holes formed in one of said base and cover outwardly from said chamber for receiving pins used to separate a base from a cover, said holes being arranged so that the pins can extend through said holes and engage the other one of said base and cover.

8. The display device of claim 7 wherein said recesses are located on the middle of the edges on said device and said holes are located on the corners of said device.

9. A display assembly comprising:

a plurality of separate display devices each formed by a base and a cover which fit together to form a chamber for receiving an article to be displayed;

wall means on at least one edge of each of said devices defining a recess open to the edge of the device; and an interlocking element including portions shaped to fit within said recesses of two adjacent devices to interconnect said display devices so that they may be utilized as an assembly for more than one article to be displayed, said recess being formed by said cover and base in a manner such that said interlock element is positioned on said base when the covers of the adjacent devices are removed and said element is captured in the recesses when the covers are positioned on the bases.

10. The assembly of claim 9 wherein said display devices are made of a relatively rigid material and said interlock element is formed so that the display devices are abutting in contact with each other so that they form a somewhat rigid sheet.

11. The assembly of claim 10 including:

means for mounting the sheet of display devices in a ring-type binder comprising a member having a hole therein for receiving a binder ring and having an interlock element captured within a recess of one of said display devices.

12. The assembly of claim 9 wherein each of said display devices is formed with a recess for receiving an interlock element on each edge of the device so that as many devices as desired may be interconnected by utilizing additional interlock elements.

13. A method of displaying coins or such items comprising:

positioning an item in an upwardly open chamber formed in a generally flat, rigid base of a display device;

positioning an interlock element in an upwardly open recess in said base outwardly from said chamber with a portion of said element extending outwardly from the edge of the base;

applying a cover to the base to close the chamber and capture the interlock element between the base and cover; and capturing the outwardly extending portion of said interlock element in a recess formed by the base and cover of a similar display device mounted adjacent to the first-mentioned display device.

* * * * *